United States Patent [19]

Bullock

[11] Patent Number: 4,531,771

[45] Date of Patent: Jul. 30, 1985

[54] RUG PULLER

[75] Inventor: Wilbur W. Bullock, Hayward, Calif., Emma R. Bullock, legal representative

[73] Assignees: William M. Kinney; A. L. Bernardi, both of Oakland, Calif.

[21] Appl. No.: 340,573

[22] Filed: Mar. 22, 1982

[51] Int. Cl.[3] ..... B66C 1/44

[52] U.S. Cl. ..... 294/104; 294/92; 414/911

[58] Field of Search ..... 294/15, 62, 63 R, 67 R, 294/67 A, 67 AB, 67 B, 67 BC, 67 C, 86 R, 92, 101, 103 R, 103 CG, 104; 414/607, 608, 618, 619, 621, 622, 626, 684, 910, 911

[56] References Cited

U.S. PATENT DOCUMENTS

| | | | |
|---|---|---|---|
| 1,135,992 | 4/1915 | Cahill | 294/62 |
| 2,519,067 | 8/1950 | Rich | 294/104 |
| 2,699,880 | 1/1955 | Haehn et al. | 414/622 |
| 2,714,969 | 8/1955 | Bartel et al. | 414/621 |
| 2,764,447 | 9/1956 | Schmidt | 294/92 |
| 2,851,300 | 9/1958 | Thayer | 294/92 X |

*Primary Examiner*—Johnny D. Cherry

[57] ABSTRACT

An "F-shaped" rug puller is disclosed for pulling stacked carpets wound in convolute rolls. The "F-shaped" rug puller has a rigid "L-shaped" arm with the central member of the "F" being pivotally attached. The L-shaped member includes two arms rigidly joined at right angles. One arm has a carpet claw at one end extending downwardly and upon the upper and outer surface of the convolute carpet roll. Medially located to the other arm of the L is a pivoted arm with a pointed aperture which imparts to the rigid "L" member the "F" configuration. This pivoted arm penetrates to and into the convolutely wound carpet roll. At the extreme end of the rigid arm remote from the carpet claw, there is preferably mounted a clevice. Typically, a tensive device such as a rope, chain or cable is used to pull the puller. In operation, the device is inserted into the spirally wound carpet with the pivoted arm penetrating into the central portion of the spirally wound convolute carpet roll. The carpet claw fits on top of the outer wind of the carpet. Upon pulling, an interaction between pivoted arm and outer claw develops urging the two, one towards another with a lever arm action about the pivoted central arm. The carpet thus is securely grasped so that as to first prevent a telescoping unwinding of the carpet. Thereafter, and with the successive spirally wound layers of carpet compressed, the roll as a whole is grasped and thereafter removed in a unitized and unwound spiral pack.

4 Claims, 3 Drawing Figures

RUG PULLER

This invention relates to a carpet puller and more particularly to an F-shaped carpet puller for grasping spirally wound carpets.

STATEMENT OF THE PROBLEM

Spirally wound carpets are typically stacked interiorly of narrow and confined spaces such as shipping containers, truck trailer bodies or even warehouse areas. When, for example, a truck trailer body is backed to a loading dock and the carpet need be removed, removal has often proved extremely difficult.

Heretofore, in order to extricate portions of the carpet load from such a configuration, an interstitial area would have to be left between the topmost carpets and the upper portion of the container. Either personnel or lifting devices would have to penetrate into and push or otherwise urge the carpets first upwardly, then outwardly from the narrow confines of the container. This awkward and ungainly handling effort continues until the carpet roll is out a sufficient distance to where each carpet as spirally wound can be individually handled.

During such pushing or moving of carpets, it is common for some spirally wound carpets to telescopically unwind. Where a carpet roll is telescopically unwound, the central and tightly wound spirals of the carpet protrude outwardly to and toward the handler. The outer and peripheral windings of carpet remain in place. When such spiral winding occurs, difficulty of handling such carpet increases.

STATEMENT OF THE PRIOR ART

Carpet claws are known. Specifically, carpet fastening tools and stretchers include planar surfaces having a series of protruding spikes and/or grooves extending therefrom. When these claws are placed typically on the finished surface of the carpet, the carpet may be stretched away from any given area. Installation of the carpet with a smooth and uninterrupted surface occurs. For example, see Strader U.S. Pat. No. 755,960 or Eramo U.S. Pat. No. 3,464,731.

Gripping and clamping devices are known. However, such gripping and clamping devices almost uniformly use their gripping features to hang onto an otherwise rigid object. As will hereinafter be emphasized, they do not simultaneously function to first grip the article to be handled and at the same time, maintain that article to be handled in a unitized and in this case a spirally wound pattern as is required in the handling of carpets. Attention is directed to Werling U.S. Pat. No. 2,378,454 and Hanner U.S. Pat. No. 2,821,426.

SUMMARY OF THE INVENTION

An "F-shaped" rug puller is disclosed for pulling stacked carpets wound in convolute rolls. The "F-shaped" rug puller has a rigid "L-shaped" arm with the central member of the "F" being pivotally attached. The L-shaped member includes two arms rigidly joined at right angles. One arm has a carpet claw at one end extending downwardly and upon the upper and outer surface of the convolute carpet roll. Medially located to the other arm of the L is a pivoted arm with a pointed aperture which imparts to the rigid "L" member the "F" configuration. This pivoted arm penetrates to and into the convolutely wound carpet roll. At the extreme end of the rigid arm remote from the carpet claw, there is preferably mounted a clevice. Typically, a tensive device such as a rope, chain or cable is used to pull the puller. In operation, the device is inserted into the spirally wound carpet with the pivoted arm penetrating into the central portion of the spirally wound convolute carpet roll. The carpet claw fits on top of the outer wind of the carpet. Upon pulling, an interaction between pivoted arm and outer claw develops urging the two, one towards another with a lever arm action about the pivoted central arm. The carpet thus is securely grasped so that as to first prevent a telescoping unwinding of the carpet. Thereafter, and with the successive spirally wound layers of carpet compressed, the roll as a whole is grasped and thereafter removed in a unitized and unwound spiral pack.

OBJECTS, FEATURES AND ADVANTAGES

An object of this invention is to disclose a carpet puller which serves two discrete functions. First, the puller, as it grasps a carpet roll to be handled, causes the carpet roll to be firmly compressed in its shipped convolute roll. As such firm compression occurs, the tendency of the carpet roll to spirally unwind is eliminated. Secondly, and once the carpet is suitably compressed so as to prevent spiral unwinding, the carpet puller of this invention enables the carpet section to be withdrawn.

An advantage of this invention is that stacked carpets can now be endwise removed from shipping containers without telescoping unwinding of the rolls.

Other objects, features and advantages of this invention will become apparent after referring to the following specification and attached drawings in which.

Figure 1:
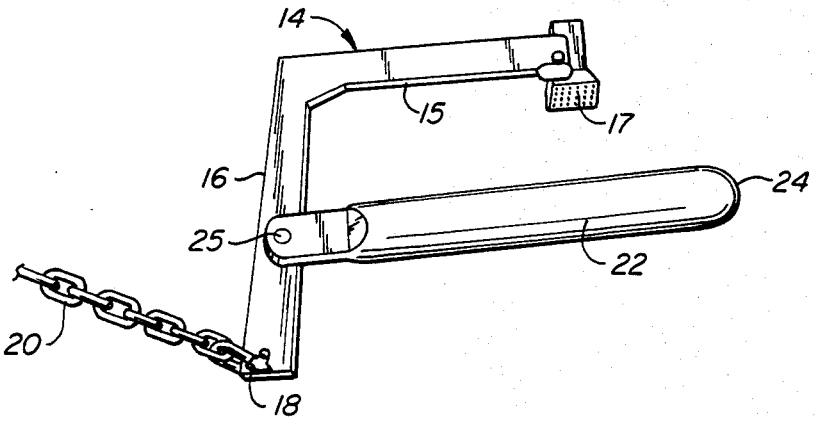
FIG. 1 is a side elevation view of the carpet puller of this invention.
Figure 2:
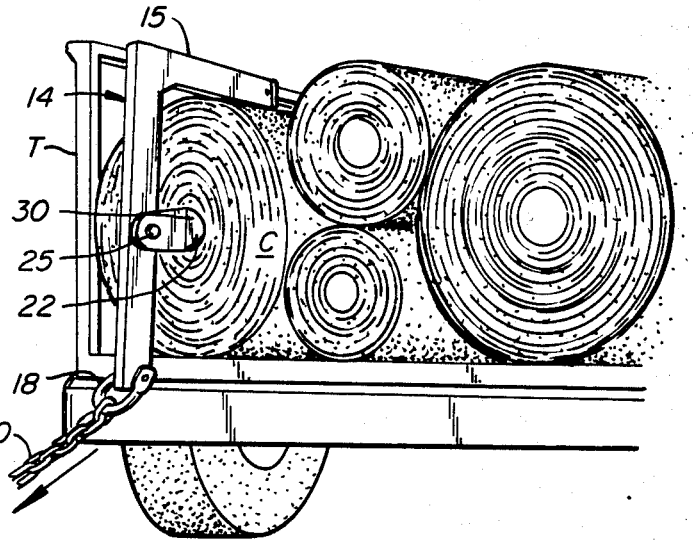
FIG. 2 is an illustration of the carpet puller of this invention installed to a carpet roll with pulling about to begin; and, FIG. 3 illustrates carpet in a convolute and spirally wound roll being pulled from the end section of a load utilizing the device of this invention.
Figure 3:
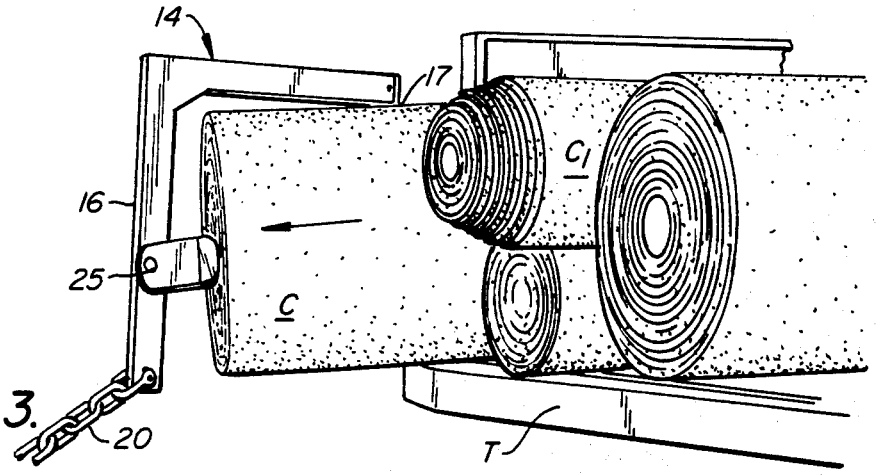

Referring to FIG. 1, the puller of this invention includes an L-shaped member 14 having a first horizontal arm 15 and a second vertical arm 16. Horizontal arm 15 has attached to one end thereof a carpet claw 17. Claw 17 is exposed downwardly and to the inside of the "L" of arms 15, 16. As should be apparent to the reader, the claw surface 17 when placed rigidly on a spirally wound carpet C, such as illustrated in FIGS. 2 and 3, will grasp the outer surface of the carpet.

At the lower surface of arm 16, there is fixed a clevice 18. Clevice 18 has fastened thereto a flexible tensive member 20, such as a chain, cable, rope or the like. As will hereinafter become apparent by pulling on clevice 18, the apparatus of this invention grips a carpet C and can cause it to be removed from the stacked relationship illustrated in FIGS. 2 and 3.

Medially of arm 16, there is fixed a pivotal arm 22. Arm 22 typically has a rounded point 24 thereon at one end and is pivotally attached to a medial portion of arm 16 at the other end. Preferably the length of pivotal arm 22 exceeds the length of horizontal arm 15. As specifically here illustrated, arm 22 is pivotally attached to the middle point of arm 16 at pivot 25.

Operation of this device may now be described. Referring to FIG. 2, it will be seen that the rearend of a trailer T is illustrated. Convolutely wound carpet has first been stacked and thereafter pushed interiorly of the truck. The problem is now to extricate the carpet.

Typically, the L-shaped bracket 14 has been placed so that its arm 15 penetrates an interstitial and exposed outer surface of the carpet. For example, it will be realized that where circular rolls are placed one upon another, interstitial areas will almost always be found where an arm 15 may penetrate. At the same time, arm 22 is penetrated into the circular area defined by the innermost spiral wind of the carpet, this round area being illustrated at 30. Typically, insertion occurs until arm 22 is fully passed interior of the carpet roll. After the device is inserted, tensive member 20 is pulled at clevice 18. Pulling first causes claw 17 to press downwardly upon and firmly grip the carpet between bar 22 in the interior thereof and bar 17 on the exterior of the carpet. This prevents the carpet roll from unwinding, as is whown at carpet $C_1$ in FIG. 3. Thereafter, and upon pulling further at clevice 18, the carpet C is removed from the load in a unitized and unwound spiral pattern as illustrated in FIG. 3.

What is claimed is:

1. In combination, a roll of carpet convolutely wound in a spiral from a small diameter to larger diameters; first and second bars fastened together at a substantially right angle in an "L" configuration; said first bar having at the remote inside end of the L configuration a carpet claw; said second bar having located between the joinder of said first bar to said second bar and the remote end of said second bar a pivotal member; said pivotal member penetrating to and into the central convolute roll of said carpet and extending therefrom; means for grasping the remote end of said second bar for pulling said second bar away from said convolutely wound carpet roll whereby said claw and said pivotal member oppose one another in grasping relation to firmly hold said carpet as convolutely wound and thereafter pull said carpet as convolutely wound.

2. The invention of claim 1 and wherein said pivotal member is longer than said first bar.

3. The invention of claim 1 and wherein an end of said pivotal member is rounded.

4. The process of pulling a carpet convolutely wound in a spiral roll comprising the steps of: providing a rigid "L" shaped member including a first and second bar; providing a carpet claw at the remote end of said first bar faced to and towards the insides of the L shaped member; providing a pivotally attached member to said second bar at the inside of said L shaped member; penetrating said carpet with said pivotally attached member so that said second bar is juxtaposed to the end of said convolutely wound carpet roll; pulling on the remote end of said second bar so that said claw presses downwardly to and upon the roll of said carpet; pulling said L shaped member to extricate said carpet in said convolutely wound roll without spiral unwinding of said carpet.

* * * * *